United States Patent [19]

Karge

[11] Patent Number: 4,817,476

[45] Date of Patent: Apr. 4, 1989

[54] SOCKET WRENCH EXTENSION

[76] Inventor: Richard Karge, 6512 Browning Rd., Pennsauken, N.J. 08110

[21] Appl. No.: 171,112

[22] Filed: Mar. 21, 1988

Related U.S. Application Data

[62] Division of Ser. No. 861,682, May 12, 1986, Pat. No. 4,733,584.

[51] Int. Cl.[4] ..... B25B 13/00

[52] U.S. Cl. ..... 81/177.85; 81/177.2

[58] Field of Search ..... 81/177.1, 177.85, 177.2; 408/322, 325, 328, 358, 361, 365, 368; 30/157

[56] References Cited

U.S. PATENT DOCUMENTS

| | | | |
|---|---|---|---|
| 1,660,989 | 2/1928 | Carpenter | 81/177.85 X |
| 1,864,466 | 6/1932 | Peterson | 81/177.85 X |
| 3,208,318 | 9/1965 | Roberts | 81/177.85 |
| 3,532,013 | 10/1970 | Haznar | 81/177.85 X |
| 3,564,954 | 2/1971 | La Pointe | 81/61 |
| 3,815,451 | 6/1974 | Penner | 81/177.85 X |
| 3,924,493 | 12/1975 | Penner | 81/177.85 |
| 4,399,722 | 8/1982 | Sardo, Jr. | 81/177.85 X |
| 4,451,982 | 6/1984 | Collins | 30/157 X |
| 4,480,511 | 11/1984 | Nickipuck | 81/177.85 X |
| 4,502,365 | 3/1985 | Hacks | 81/177.85 X |

*Primary Examiner*—Debra Meislin
*Attorney, Agent, or Firm*—Norman E. Lehrer

[57] ABSTRACT

A locking socket wrench extension includes an elongated extension member having an axially aligned opening at one end adapted to receive the driving stud of a ratchet wrench or similar tool and including a socket drive stud at the other end thereof. A socket engaging ball which is adapted to lock a socket onto the extension stud is located in a transverse slot in the side wall of the extension stud. An elongated pin is contained within and coaxial with the extension member and is movable rearwardly and forwardly. When in the forward position, the pin moves the ball into its locking position. In one embodiment, the pin extends rearwardly into the stud opening. As the driving stud of a ratchet wrench is inserted into the opening, the pin is pushed forwardly to lock the ball in place. In another embodiment, the pin is biased forwardly in the locking position but can be moved rearwardly by manually sliding a button located on the exterior of the extension which is interconnected with the pin.

1 Claim, 2 Drawing Sheets

SOCKET WRENCH EXTENSION

This is a division of application Ser. No. 861,682 filed May 12, 1986, now U.S. Pat. No. 4,733,584.

BACKGROUND OF THE INVENTION

The present invention is directed toward a socket wrench extension and more particularly toward such an extension and unlocking a socket to the end thereof.

Various quick-release mechanisms have been developed over the years for socket wrenches. Such devices are shown, for example, in U.S. Pat. Nos. 3,208,318; 3,532,013; 3,564,954 and 3,815,451. Such devices provide means for locking a socket onto the drive stud of a wrench and for releasing the same when desired. Many of these devices have met with much success.

These prior devices are useful when a socket is connected directly to the driving stud of the wrench or similar device. However, when an extension member is utilized between the wrench and the socket, the quick-release mechanism only functions between the wrench and the extension member. The socket is merely force fit onto the other end of the extension member.

Several proposals have been suggested in the past for providing an extension member with a release and/or locking means for the socket mounted at the end thereof. One such device is shown, for example, in U.S. Pat. No. 4,399,722. The adapter or extension member of this patent has a substantially hollow bore with a spring biased pin therein. The forward end of the pin includes a cam surface which normally locks a locking ball in the locking position. When the pin is moved forwardly, the ball falls into its unlocking position. The pin is moved forwardly through the use of a specially designed wrench which includes a button at the back thereof. The button can be manually pressed from the back of the wrench. This, in turn, pushes a pin through the head of the wrench and through a central opening in the wrench drive stud which engages the pin in the extension member to move forwardly.

To the best of Applicant's knowledge, the device shown in U.S. Pat. No. 4,399,722 has not proven to be commercially valuable. This is, perhaps, due to the fact that a specially designed wrench is needed to utilize the same.

The devices shown in U.S. Pat. Nos. 3,924,493 and 4,480,511 also are designed to lock a socket onto an extension member and are capable of doing so without the use of a specially designed wrench. The devices shown in these patents can be utilized with substantially any known socket wrench. The design of the first-mentioned patent, however, does not provide a positive lock on the socket. It would appear that with sufficient force, the socket can still cause the locking ball to move so that the socket can be removed. The second-mentioned patent includes a relatively complex locking arrangement which, because of the design thereof, requires two hands to operate the same. The extension member must be held with one hand while the other hand grasps and moves a movable collar located at the front of the member. Again, to the best of Applicant's knowledge, neither of these devices has been commercially successful.

SUMMARY OF THE INVENTION

The present invention is designed to overcome the deficiencies of the prior art described above and to provide a locking socket wrench extension which is easy to utilize and inexpensive to manufacture. The locking socket wrench extension of the present invention includes an elongated extension member having an axially aligned opening at one end adapted to receive the driving stud of a ratchet wrench or similar tool and including a socket drive stud at the other end thereof. A socket engaging ball which is adapted to lock a socket onto the extension stud is located in a transverse slot in the side wall of the extension stud. An elongated pin is contained within and coaxial with the extension member and is movable rearwardly and forwardly. When in the forward position, the pin moves the ball into its locking position. In one embodiment, the pin extends rearwardly into the stud opening. As the driving stud of a ratchet wrench is inserted into the opening, the pin is pushed forwardly to lock the ball in place. In another embodiment, the pin is biased forwardly in the locking position but can be moved rearwardly by manually sliding a button located on the exterior of the extension which is interconnected with the pin.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
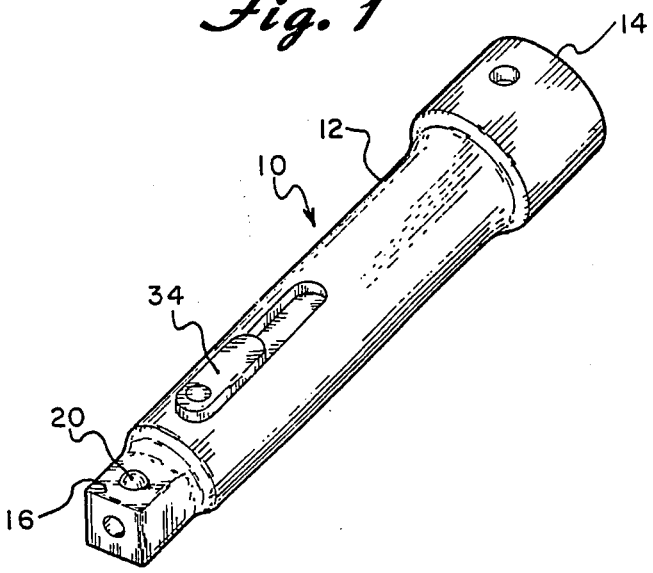
FIG. 1 is a perspective view of a first embodiment of a locking socket wrench extension constructed in accordance with the principles of the present invention.

Referring now to the drawings in detail wherein like reference numerals have been used throughout the various figures to designate like elements, there is shown in FIG. 1 a perspective view of a locking socket wrench extension constructed in accordance with the principles of the present invention and designated generally as 10. Extension 10 includes an elongated extension member 12 having an axially aligned opening 14 adjacent one end thereof (the right end as viewed in the figures). The opening 14 is substantially square in cross section and is adapted to receive the driving stud of a ratchet wrench or similar tool in the known manner.

Figure 2:
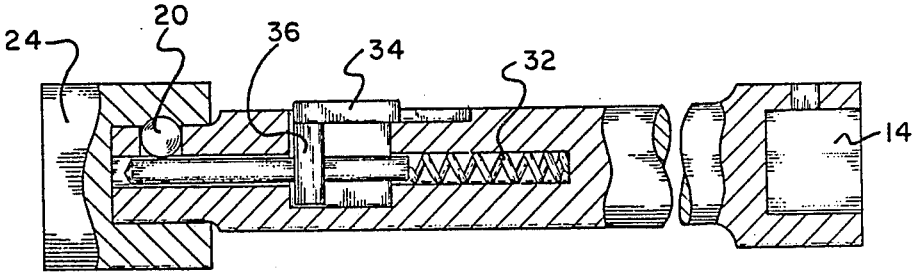
FIG. 2 is a cross-sectional view taken through the line 2—2 of FIG. 1 and showing the extension connected to a socket.
Figure 3:
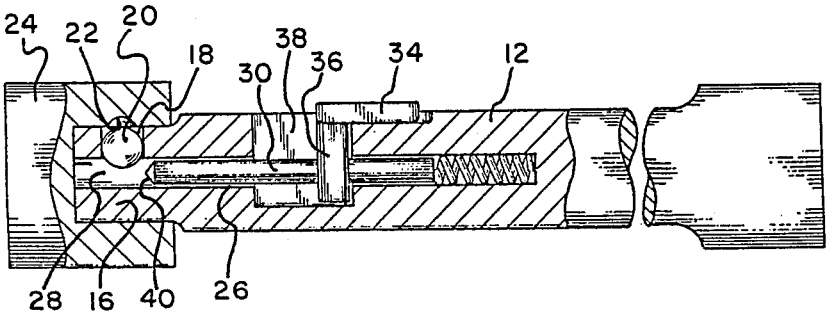
FIG. 3 is a view similar to FIG. 2 showing the extension in the unlocked position.
Figure 4:
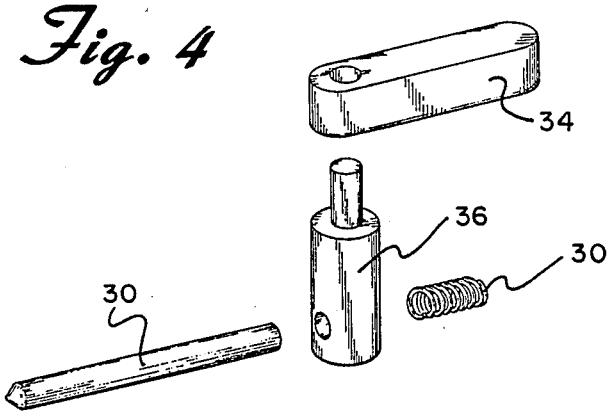
FIG. 4 is an exploded view of a portion of the locking mechanism utilized with the invention.

The other remote end of the extension member 12 includes a socket drive stud 16 of substantially square cross section formed thereon. A transverse slot 18 (FIGS. 2 and 3) is formed in one of the walls of the socket drive stud 16 and a socket engaging ball 20 is contained within the slot 18. The slot is formed in a known manner so that the ball is movable within the slot but cannot be removed from the same. The ball is movable between a locking position wherein the upper portion of the ball lies outside of the slot to engage a recess 22 in a socket 24 as shown in FIG. 2 and an unlocking position where the ball moves inwardly toward the center of the socket drive stud 16 as shown in FIG. 3.

An elongated coaxial bore 26 is formed within the extension member 12 at the center thereof. The forward end 28 of the bore 26 intersects the slot 18 beneath the ball 20. Since the diameter of the bore 26 is less than the diameter of the slot 18, the ball 20 is prevented from entering the bore 26 and remains in the slot. Located within the bore 26 is an elongated pin 30. The diameter of the pin 30 is slightly less than the inner diameter of the bore 26 so that the pin 30 is slideably movable therein. The length of the pin 30 is less than the length of the bore 26 so that the pin is capable of limited axial movement within the bore.

Also located within the bore 26 at the rear thereof is a compression spring 32. The spring 32 normally biases the pin 30 forwardly or to the left as shown in the Figures wherein the forward end of the pin holds the ball 20 upwardly into its locking position as shown in FIG. 2.

A button 34 which is accessible from the outside of the extension member 12 is rigidly interconnected to the pin 30 through the upstanding post 36. A slot 38 is formed in the side wall of the extension member 12 to accommodate movement of the post 36. As can clearly be seen from FIGS. 2 and 3, the radially and axially extending slot 38 opens to the outside of the extension member at one side only. The portion of the wall of the extension member directly opposite the opening, i.e. at a location 180° from the opening or at the bottom of the extension member as viewed in FIGS. 2 and 3, is solid. While gripping the back of the extension member 12 with the fingers of one's hand, the thumb can be used to move the button 34 rearwardly against the force of spring 32 which will also move the pin 30 rearwardly into the unlocking position shown in FIG. 3 where the ball 20 moves out of engagement with the socket 24.

When the button 34 is released, the button, post 36 and pin 30 again move forwardly through the force of spring 32. The forwardmost end of the pin 26 is pointed as shown at 40 to essentially form a cam surface thereon. This cam surface 40 engages the bottom of the ball 20 as the pin 30 is moved forwardly to move the ball 20 upwardly. The ball is then held in the upward or locking position as shown in FIG. 2 when the pin reaches its forwardmost position.

Figure 5:
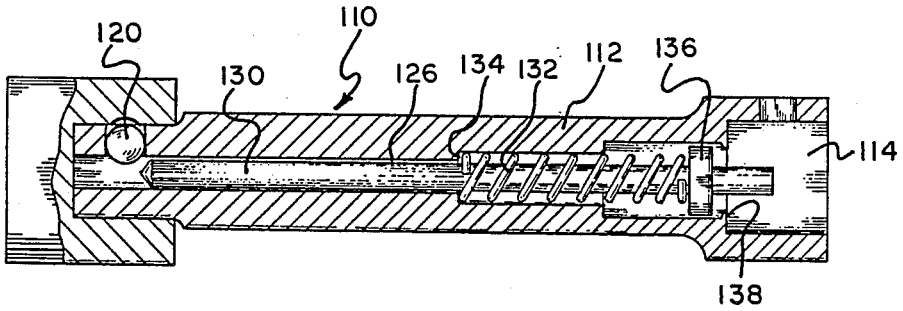
FIG. 5 is a cross-sectional view of a second embodiment of the invention showing the locking mechanism in unlocked condition.
Figure 6:
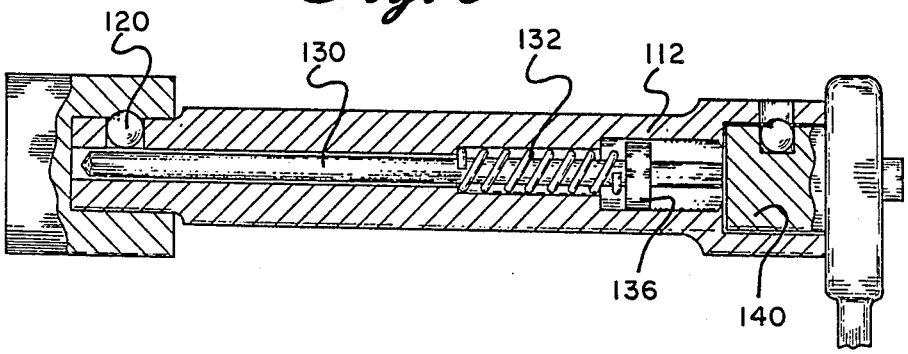
FIG. 6 is a view similar to FIG. 5 but showing the locking mechanism in the locked position.

A modified form of the locking socket wrench extension of FIGS. 1–4 is shown in FIGS. 5 and 6 and is designated generally as 110. Extension 110 is similar in many ways to the extension 10 described above except that the pin 130 is longer than pin 30. The bore 126 also extends all the way through the rear end of the extension member 112 and provides communication to the driving stud opening 114. Compression spring 132 extends between the step 134 formed on the extension member 112 around the bore 126 and the stop member 136 fixed to the pin 130 adjacent the rear end thereof. As a result, the pin 130 is biased rearwardly as shown in FIG. 5.

The position shown in FIG. 5 is the unlocking position since the forward end of the pin 130 is away from the ball 120 so that the ball can move into its unlocking position. As shown in FIG. 5, when the pin 130 is in its unlocking position, the rearwardmost end of the pin enters the opening 114. Further rearward movement of the pin is prevented by the stop member 136 engaging the stops 138 formed around the forward end of the opening 114.

As shown in FIG. 6, the pin 130 can be moved forwardly into its locking position by pressing on the rearwardmost end of the pin. This is done automatically whenever the driving stud such as stud 140 is inserted into the opening 114. The strength of the spring 132 is selected so that it will have sufficient force to return the pin 130 to its unlocking position whenever the driving stud of a wrench is removed from the opening 114. However, the strength of the spring will not be great enough to force the wrench out of the opening 114.

Figure 7:
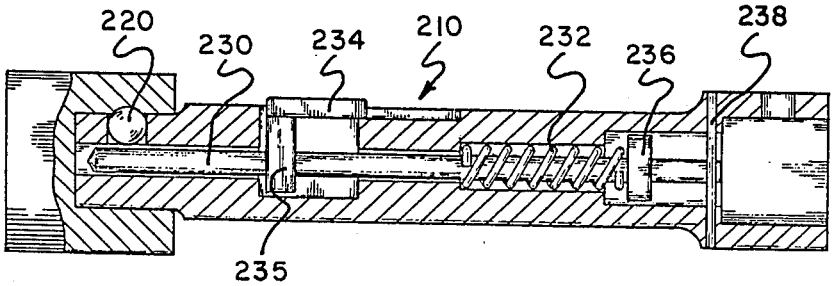
FIG. 7 is a view similar to FIG. 6 but showing a still further embodiment of the invention.

A still further embodiment of the invention is shown in FIG. 7 and is designated generally as 210. The extension 210 is again constructed similarly to extensions 10 and 110 but includes a button 234 which can be used to help return the pin 230 back to its unlocking position in the event that the spring 232 is incapable of doing so. This may be necessary in some situations where the pin 230 may somehow get wedged forwardly into locking position as a result of poor tolerances in manufacture, temperature changes or other conditions. The button 234 is interconnected with the pin 230 through post 235 and functions in substantially the same manner as the button 34. FIG. 7 also shows an alternate form of a stop member 238 in the form of a pin in lieu of the stop 138 in order to limit the rearward movement of the stop 236 and thus the pin 230.

The present invention may be embodied in other specific forms without departing from the spirit or essential attributes thereof and accordingly reference should be made to the appended claims rather than to the foregoing specification as indicating the scope of the invention.

I claim:

1. A locking socket wrench extension comprising:

an elongated extension member having an axially aligned opening adjacent one end thereof adapted to receive the driving stud of a ratchet wrench or similar tool;

the end of said extension member remote from said one end including a socket drive stud thereon;

a socket retaining means including a socket engaging ball carried by said socket drive stud, said retaining means including a transverse slot formed in the wall of said socket drive stud, said ball being contained within said transverse slot and being movable between a locking position wherein a portion of said ball lies outside of said transverse slot and said socket drive stud and an unlocking position wherein said ball moves inwardly toward the center of said socket drive stud;

an elongated bore within said extension member and coaxial therewith, the forward end of said bore intersecting said transverse slot;

a radially and axially extending slot formed in the wall of said extension member intermediate the ends thereof, said radially and axially extending slot intersecting said bore and communicating with the outside of said extension member at an opening at one side of said extension member only; the portion of the wall of said extension member directly opposite said opening being solid;

a radially extending post located within said radially and axially extending slot and extending into said bore, said post having a hole therein coaxial with said bore and being axially movable within said radially and axially extending slot;

an elongated pin located within said bore and being capable of limited axial movement, said pin passing through the hole in said post and being secured to the post for movement therewith, the forward end of said pin being adapted to move said ball into said locking position when said pin moves forwardly, said ball moving into said unlocking position when said pin moves rearwardly;

spring means within said extension member for biasing said pin forwardly, and a slideable button on the exterior of said extension member and interconnected with said pin via said post for moving said pin rearwardly.

* * * * *